United States Patent [19]

de Ronde

[11] 4,383,227

[45] May 10, 1983

[54] SUSPENDED MICROSTRIP CIRCUIT FOR THE PROPAGATION OF AN ODD-WAVE MODE

[75] Inventor: Frans C. de Ronde, Eindhoven, Netherlands

[73] Assignee: U.S. Philips Corporation, New York, N.Y.

[21] Appl. No.: 276,595

[22] Filed: Jun. 23, 1981

Related U.S. Application Data

[63] Continuation of Ser. No. 86,846, Oct. 22, 1979, abandoned.

[30] Foreign Application Priority Data

Nov. 3, 1978 [NL] Netherlands ..... 7810942

[51] Int. Cl.[3] ..... H01P 3/08; H01P 5/10; H01P 5/20

[52] U.S. Cl. ..... 333/121; 333/1.1; 333/128; 333/22 R; 333/26; 333/238; 333/246; 333/263

[58] Field of Search ..... 333/22 R, 26, 116, 121, 333/123, 128, 136, 238, 246, 263

[56] References Cited

U.S. PATENT DOCUMENTS

| | | | |
|---|---|---|---|
| 3,594,664 | 7/1971 | Lipetz | 333/238 X |
| 3,818,385 | 6/1974 | Mouw | 333/238 X |
| 4,135,170 | 1/1979 | Baril et al. | 333/246 X |

OTHER PUBLICATIONS

Gupta et al., *Microstrip Lines and Slotlines,* Aertech House, 1979, Dedham, Mass., pp. 196, 265–267 & title page.

*Primary Examiner*—Paul L. Gensler
*Attorney, Agent, or Firm*—James J. Cannon, Jr

[57] ABSTRACT

A suspended microstrip circuit having a dielectric substrate arranged in parallel between two parallel metal planes. First and second strip conductors are provided on the substrate, the second strip conductor being in parallel with the first strip conductor and coupled thereto. A wave phenomenon can propagate through the conductor pair in an odd mode. The metal box accommodating the microwave circuit may now be much greater so that in most cases one box is sufficient. Microwave components such as Magic-T, series-T, shunt-T, circulators, filters, attenuators, can be implemented with the suspended microstrip line.

9 Claims, 21 Drawing Figures

SUSPENDED MICROSTRIP CIRCUIT FOR THE PROPAGATION OF AN ODD-WAVE MODE

This is a continuation of application Ser. No. 086,846, filed Oct. 22, 1979, abandoned.

BACKGROUND OF THE INVENTION

1. Field of the Invention

The invention relates to a suspended microstrip circuit comprising two parallel metal planes, a substrate arranged parallel thereto and therebetween and a first strip conductor on a first major surface of the substrate.

2. Description of the Prior Art

Such a suspended microstrip circuit is disclosed in the article by Dr. H. E. Brenner, "Use a computer to design suspended-substrate IC"s, Microwaves, September 1968, pages 38–46. By means of, inter alia, microstrip lines, microwave circuits such as filters, attenuators, T-junctions, mixers, circulators etc. can be made for, inter alia, radar and communication purposes.

Usually, such a microwave circuit is disposed in a fully closed conducting box. This box serves as a return path for the currents in the circuit; it shields the circuit from radiation from the environment and prevents radiation from the microwave circuit to the environment. The conducting box constitutes a length of "waveguide" which is short-circuited at both ends. The width of this "waveguide" is chosen so that no mode can propagate in it at the working frequency of the microwave circuit. This means that the "waveguide" must be rather narrow. For a microwave circuit of average size, it is therefore usually necessary to arrange the circuit in a plurality of separate, conducting boxes. In addition, this "waveguide" is difficult to realize at higher frequencies.

To obviate these drawbacks, it has already been proposed to use a wide "waveguide" which, in order to attenuate the modes which may occur, is provided with attenuation layers, the drawback then being that this entails considerable losses.

It is an object of the invention to provide a suspended microstrip circuit of the type defined in the opening paragraph which mitigates said drawbacks and inhibits in a simple manner the excitation and propagation of unwanted modes.

SUMMARY OF THE INVENTION

According to the invention the suspended microstrip circuit is characterized in that provided on the first surface of the substrate there is a second strip conductor which is arranged in parallel with and at a short distance of the first strip conductor and is coupled to the first strip conductor and in that a symmetrical supply source is connected between the conductors for generating a wave phenomenon in exclusively odd mode and that a symmetrical load is connected between the conductors.

It should be noted here that it is known to couple a microstrip line to another microstrip line in order to effect a filter or a directional coupler. An essential feature then is, however, that even-mode as well as odd-mode wave propagation occurs.

When excited in an odd mode, the first and second strip conductors have equally large potentials but of opposite polarity, and equal currents flow through the conductors in opposite directions. The electric field is odd-symmetrically with respect to a perpendicular bisecting plane of the conductors and the field is concentrated near the conductors. The electric field near the walls of the "waveguide" is, on the contrary, small.

The invention is based on the recognition that when two strip conductors between parallel conductive planes are excited in an odd mode, the associated currents in the planes have low values and the "waveguide" will not be excited. Consequently, the "waveguide" can be made oversized.

A further advantage is that the impedance range of a suspended microstrip circuit embodying the invention is larger than for a suspended microstrip line having a single strip conductor and TEM wave propagation.

A suspended microstrip circuit embodying the invention has the additional advantage that, compared with other planar waveguiding structures such as slot line and coplanar waveguide, no resonances can occur through the large metal surfaces present on the substrate with those configurations.

By means of a length of a waveguiding structure, it is possible to realize a reactive element having, in principle, any possible value: the element has an inductive or a capacitive character depending on its length relative to the operating wavelength and the nature of the termination (open/short circuit). Such lengths of waveguide are inter alia used for the realization of microwave circuits. Microwave circuits such as a balanced ring, a filter, an attenuator, a T-junction, a mixer, a circulator, etc. can accordingly be realized in suspended microstrip line embodying the invention.

Asymmetries in a suspended microstrip line or a microwave circuit realized therewith may result in even modes being excited. The currents, associated with even modes, in the two metal planes are—in contrast to the currents due to the odd mode—considerable, because they add to intensify one another. This offers the possibility to attenuate even modes by composing the metal planes of conductive and resistive materials.

Microwave circuits realized in odd-mode suspended microstrip circuit technique have a high degree of symmetry for preventing the excitation of even modes as their common characteristic.

At a bend in suspended microstrip lines, in order to keep the electric length of the two conductors equal the first and second conductors are interrupted by means of a slot into the direction of the bisector of the deflection angle and the first conductors are cross-wise connected to the second conductors.

For suspended microstrip circuits it is possible to utilize also the second major surface of the dielectric substrate for the accommodation of a waveguiding structure. T-junctions, such as a series-T, a shunt-T or a "Magic-T" have been realized in this manner. The utilization of both surfaces can result in very good symmetry and a compact structure.

BRIEF DESCRIPTION OF THE DRAWINGS

Embodiments of the invention will now be described, by way of example, with reference to the accompanying diagrammatic drawings, in which the same or corresponding components in the different Figures having been given the same reference numerals, and in which.

DESCRIPTION OF THE PREFERRED EMBODIMENT

Figure 1:
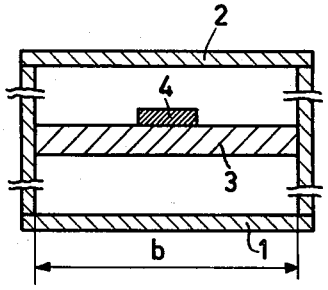
FIG.1 PRIOR ART
FIG. 1 is a cross-sectional view of a known suspended microstrip line.

The known suspended microstrip line shown in FIG. 1 comprises, parallel to one another, a metal plane 1, a metal plane 2, and a dielectric substrate 3 for a strip conductor 4. This suspended microstrip line operates in a TEM mode. The metal planes 1 and 2 form part of a conducting box which completely envelopes substrate 3 and the conductor 4 disposed thereon. A suspended microstrip line has some advantages with respect to the conventional microstrip line configuration which is provided on a substrate with a metal plane on the other major surface. A first advantage of suspended microstrip is that inhomogenities in the substrate produce a much lower degree of disturbance, as the dielectric is predominantly air. A second advantage is that the common 50 Ohm impedance can be realized with reasonably wide conductors, which reduces the photo-lithographic accuracy requirements to be satisfied during production. In addition, the conductor losses are smaller, which is particulary important for uses in the mm-wave range. A third advantage is that both sides of the substrate for a suspended microstrip line can be utilized for the provision of microwave circuits.

The conducting box, in which the microstrip line and the microwave circuits realized with, inter alia, microstrip lines are accommodated, forms a transmission line structure in the form of a waveguide. The width of this guide is chosen so that no wave modes can propagate therein in the operating frequency range of the circuit. This means that the width b of the guide must be rather small. A drawback is that even a microwave circuit of average size must be accommodated in a plurality of separate metal boxes which is expensive and furthermore difficult to realize for higher frequencies.

Figure 2:
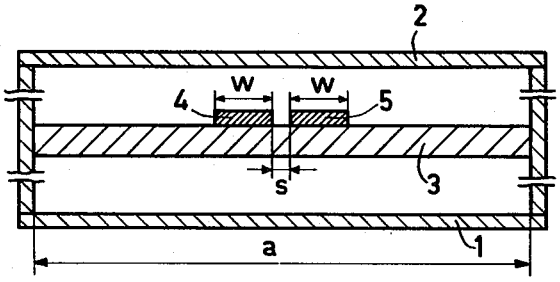
FIG. 2 is a cross-sectional view of a suspended microstrip circuit embodying the invention.

FIG. 2 is a cross-section of a suspended microstrip circuit embodying the invention. A second strip conductor 5 is provided parallel to the first conductor 4 on the dielectric substrate 3. The conductors 4 and 5 are electromagnetically coupled to one another because the gap s between the first conductor 4 and the second conductor 5 is (much) smaller than the width w of the two conductors 4 and 5.

A large impedance range can be covered with a suspended microstrip line for a circuit embodying the invention. A low characteristic impedance can be realized by means of wide conductors (w large) spaced from one another at a small distance s, it being possible to further reduce the characteristic impedance by means of either a metal cover extending over the conductor pair or a metal plane on the other side of the substrate. A higher characteristic impedance is achieved by means of narrow conductors (w small) at a relatively large distance s from one another. The conductors 4 and 5 are excited and operated in the odd mode. This means that the two conductors have equally large potentials, but of opposite polarity, and that equal currents flow through the two conductors into opposite directions. The electric field is odd-symmetrically with respect to a perpendicular bisecting plane of the two conductors 4 and 5. The electric field is concentrated between the two conductors 4 and 5. Near the conducting box and, consequently, at some distance from the conductors, the resulting field is very small owing to the equally large but of opposite polarity, potentials. The currents associated with the odd wave modes in the metal planes 1 and 2 are therefore only small. Excitation of an odd-wave mode has the considerable advantage that the "waveguide" is hardly excited and can therefore be made oversized. From experiments it has appeared, for example, that resonances which occurred with even-mode excitation of a microwave circuit arranged in a 5-times oversized "waveguide" did not occur with odd-mode excitation.

Weak wall currents in the metal planes 1 and 2 have the further advantage that experiments with microwave circuits can be performed with one of the metal planes 1 and 2 removed.

Furthermore, the suspended microstrip line has the advantage that, compared with other planar wave guides such as slot line and coplanar waveguide, no resonances can be produced owing to the large metal surfaces present in those configurations on the substrate and which also serve as conductor. For brevity, the suspended microstrip line for a circuit embodying the invention will be denoted SOM-line (Suspended Odd-mode Microstrip) hereinafter.

Figure 3:
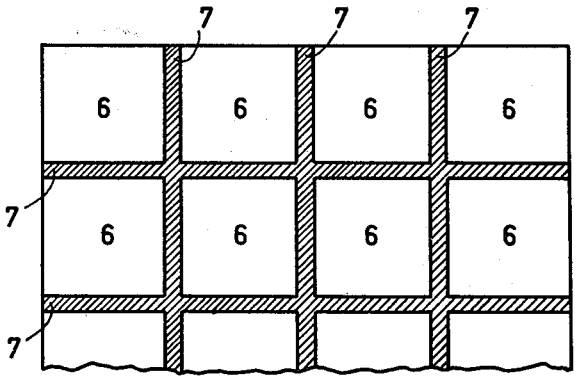
FIG. 3 is a plan view of a portion of a metal plane for use in the embodiment of FIG. 2, comprising a mosaic of readily conducting squares separated by resistive strips.

To prevent even modes from being excited in the case of odd-mode excitation, the conductors and the microwave circuits effected therewith must be of a symmetrical design. Owing to, inter alia, manufacturing tolerances, this can, however, not always be realized in practice. It is, however, inherent to the excitation in the even mode that this is accompanied by relatively large wall currents in the metal planes 1 and 2. By making these metal planes 1 and 2 alternately of readily conducting material and of resistive material, these currents and, consequently, the even mode waves can be attenuated. FIG. 3 shows a metal plane 1 or 2 made of conducting square portions 6 of good electrical conductivity which are separated by a network of conductors 7 of a material having a poor electrical conductivity.

If a wave is sent into a length of waveguide which is short-circuited at one end, the wave is reflected at that end. It returns to the input with a phase shift with respect to the incoming wave, which shift depends on the length of the waveguide. A reflection can also be caused by discontinuities other than a short-circuit. Such a length of transmission line can behave as a reactive element; depending on the wavelength and on the nature of the termination, it has an inductive, a real (resistive) or a capacitive character. Such lengths of waveguide are inter alia used to realize microwave circuits; they can be arranged transverse to a continuous waveguide. Numerous microwave circuit components can be realized with suspended microstrip line. These components are characterized by the high degree of symmetry of the design in order to prevent excitation of unwanted wave modes.

Figure 4:
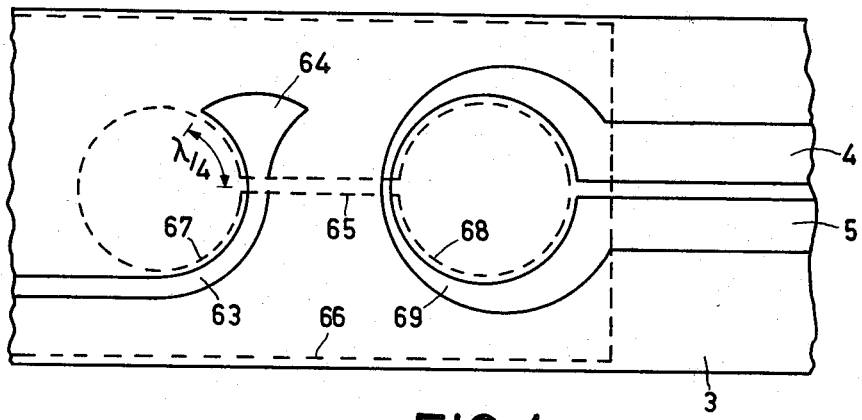
FIG. 4 is a plan view of a mode transducer for use in the embodiment of FIG. 2.

FIG. 4 shows a mode transducer in suspended microstrip line. The signal converter forms part of a balanced supply source for generating a wave exclusively in odd mode. The signal converter comprises a microstrip line which is formed by a strip conductor 63 provided on a first major surface of the substrate 3 and a conducting plane 66 provided on the second major surface. The conductor patterns provided on the first surface are indicated in the Figure by means of solid lines and those on the second surface are indicated by means of dashed lines. The microstrip line 63 is terminated by a wide-band impedance in the form of a fan-like conductor 64 which has a length of $\lambda/4$. An unbalanced supply source can be connected to the microstrip line 63. A slot transmission line 65, which is formed by a slot in the conducting plane 66, is coupled to the microstrip line 63. The slot transmission line 65 is terminated at each end by a very high terminating impedance formed by disc-shaped recesses 67 and 68, respectively, in the conducting plane 66. If a TEM-wave propagates in microstrip line 63, the electromagnetic field of the slotline will be excited on the slot transmission line 65. The slot transmission line 65 is coupled to a ring-shaped connecting conductor 69, provided on the first surface, connecting the two adjacent ends of the conductors 4 and 5, respectively, of the SOM-line. The coupling between the slot line 65 and the connecting conductor 69 functions as an electromagnetic series-T junction, equally large but opposite fields being generated in the side arms of the "T" (portion of connecting conductor 69) on opposite sides of a point which is situated symmetrically with respect to the two conductors of the SOM-line, so that a wave is generated exclusively in the odd mode in the SOM-line. The length of the connecting conductor 69 is preferably $\lambda/2$. The microwave circuit of FIG. 4 is reciprocal and can be used in that form to connect an unbalanced load in a balanced manner to the SOM-line.

Figure 5:
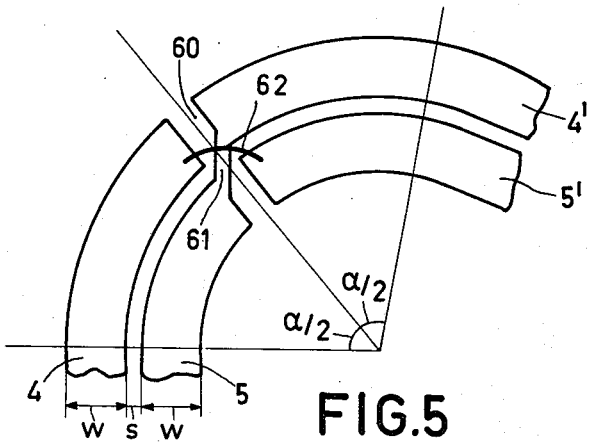
FIG. 5 is a plan view of a bend in a suspended microstrip circuit embodying the invention.

FIG. 5 shows a bend in suspended microstrip line. The two strip conductors are concentric arcs subtending an angle $\alpha$. The two strip conductors are divided by a radial slot 60 bisecting the angle $\alpha$ into conductor portios 4 and 4', and 5 and 5', respectively; the conductor portions 5 and 4' are interconnected by a conducting strip 61 provided on the substrate 3 and the conductor portions 4 and 5' are interconnected by a wire 62, which crosses over strip 61.

Figure 6:
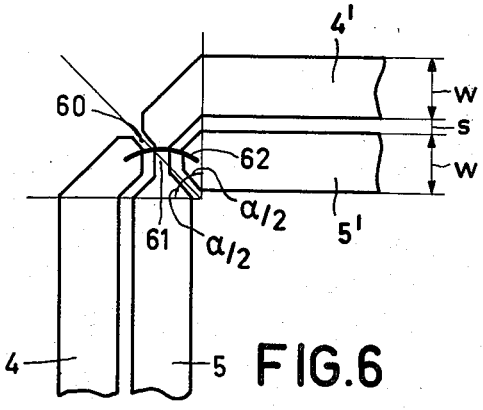
FIG. 6 is a plan view of a further bend in a suspended microstrip circuit embodying the invention.

FIG. 6 shows a further bend in suspended microstrip line. An advantage of each of these two bends is that the electrical path length around the bend is the same for both strip conductors, so that phase deviations between the electrical phenomena on the conductors are prevented.

Figure 7:
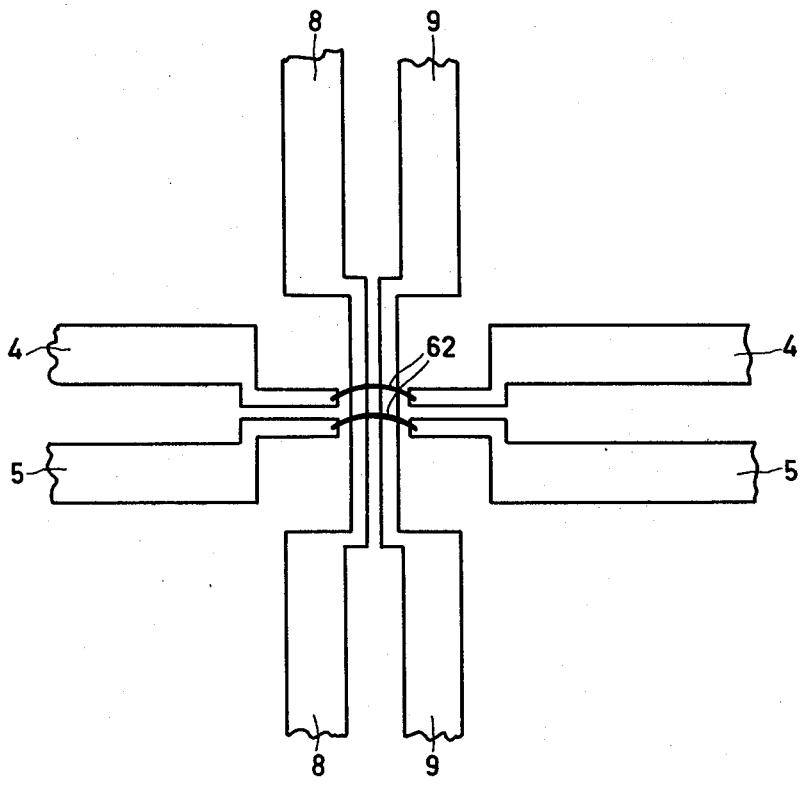
FIG. 7 is a plan view of a junction of two suspended microstrip lines for a circuit embodying the invention.

FIG. 7 shows a first suspended microstrip line comprising conductors 4 and 5 crossing over a second suspended microstrip line comprising conductors 8 and 9. Near the cross-over, the conductors of the SOM-lines 4–5 and 8–9 are narrower and the gap between the two conductors of each line is reduced in order to keep the characteristic impedance of the SOM-lines at the same values. The SOM-line 4–5 is interrupted over a length greater than the width of the SOM-line 8–9 at the cross-over. The two portions of each of the conductors 4 and 5 on opposite sides of the cross-over are interconnected by respective wires 62. This arrangement has the advantage that the area of interaction of the two pairs of conductors is very small, so that good decoupling is obtained.

Since the microstrip line is formed as a suspended microstrip line, it is possible to use also the second major surface of the dielectric substrate 3 for the application of microwave structures. A T-junction can utilize this possibility. A T-junction is used inter alia as a power divider and in bridge circuits. In such T-junctions shown in FIGS. 8, 9 and 10, the conductors provided on the first major surface of the dielectric substrate 3 are shown symbolically by means of solid lines, and the conductors on the second major surface are shown by means of dashed lines. The gap s between the conductors is not shown to scale.

Figure 8A:
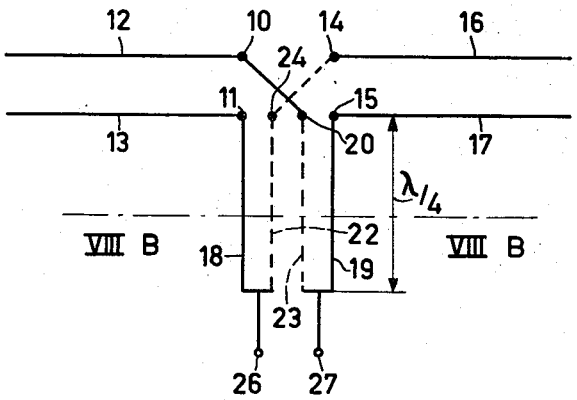
FIG. 8*a* is a schematic plan view of a series-T junction for a circuit embodying the invention.
Figure 8B:
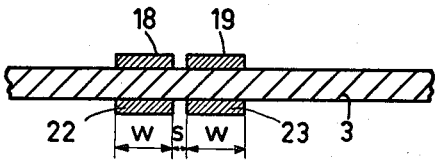
FIG. 8*b* is a cross-sectional view on the line VIII B—VIII B in FIG. 8*a;*

FIG. 8*a* shows a series-T junction. On the first major surface of substrate 3, a first conductor pair 12, 13 is connected to a first terminal 10 and a second terminal 11 and a second conductor pair 16, 17 is connected to a third terminal 14 and a fourth terminal 15. The first, second, third and fourth terminals are at the corners of an imaginary rectangle, the first and the second conductor pairs being aligned. A third conductor pair 18, 19 is connected at one end to the second terminal 11 and to the fourth terminal 15 and at the other end to terminals 26 and 27, and is at right angles to the first and second conductor pairs. A fourth conductor pair 22, 23 is provided on the second major surface of the substrate 3 opposite to and parallel with the third conductor pair 18, 19, as shown in FIG. 8*b* by the cross-section on the line VIII B—VIII B in FIG. 8*a*. A first end of the fourth conductor pair 22, 23 is connected to a sixth terminal 24 and to a fifth terminal 20. The third and fourth conductor pairs 18, 19 and 22, 23 each have a length of a quarter wavelength at the operating frequency. The second end of the fourth conductor pair 22, 23 is connected (for example through a hole in the substrate 3) to the third conductor pair 18, 19. The sixth terminal 24 is connected to terminal 14 and the fifth terminal 20 is connected to terminal 10. The characteristic impedance of the conductor pair 12, 13 is equal to that of the conductor pair 16, 17.

When the series-T junction is used as a power divider the operation is as follows. When a signal source, (not shown) is connected to the terminals 26 and 27 of the conductor pair 18, 19, the applied energy is divided equally between conductor pair 12, 13 and conductor pair 16, 17. In the reverse case the T-junction operates as follows. A first wave propagates on the conductor pair 16, 17 and a second wave propagates on the conductor pair 12, 13. The vectorial difference of the two waves is available at the terminals 26 and 27. Equal phases and amplitudes of the two waves result in a signal equal to zero at the terminals 26 and 27.

This series-T junction has the advantage that, by means of two pairs of conductors 18, 19 and 22, 23, each a quarter wavelength long, the available signal source may be considered as performing the function of two signal sources which operate independently from one another, one being arranged between conductor 12 and 16 and one between conductors 13 and 17.

A further advantage is that by using both surfaces of the substrate 3 a balanced and compact T-junction is realized.

Figure 8C:
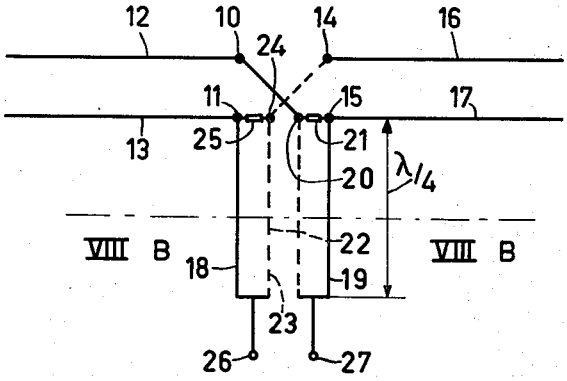
FIG. 8*c* is a schematic plan view of a modification of the series-T junction of FIG. 8*a;*

FIG. 8*c* shows a balanced series-T (a so-called ISO-TEE) obtained by connecting in the series-T of FIG. 8*a* a first resistor 21 between the fourth terminal 15 and the fifth terminal 20 and by connecting a second resistor 25 between the second terminal 11 and the sixth terminal 24. Resistors 21 and 25 have the same resistance values. By means of these resistors and by a proper choice of the characteristic impedances of the three SOM-lines, it is possible to decouple the side arms 12–13 and 16–17. Any reflected power resulting from mismatching is dissipated in the resistors 21 and 25.

Figure 9A:
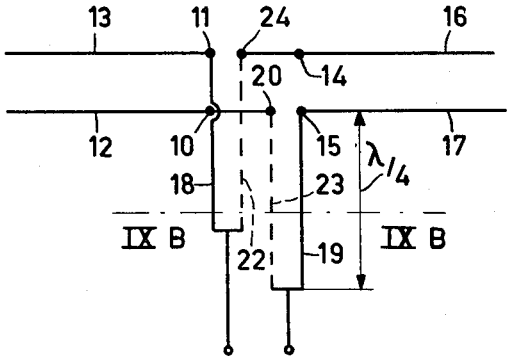
FIG. 9*a* is a schematic plan view of a shunt-T junction for a circuit embodying the invention.
Figure 9B:
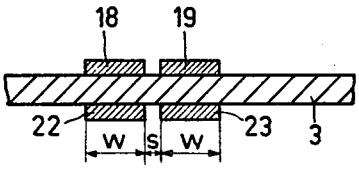
FIG. 9*b* is a cross-sectional view on the line IX B—IX B in FIG. 9*a;*

FIG. 9*a* shows a shunt-T junction. On the first major surface of the substrate 3, the first conductor pair 12, 13 is connected to the terminals 10, 11 and the second conductor pair 16, 17 to the terminals 14, 15. The third conductor pair 18, 19 is connected to the terminals 11, 15 and is at right angles to the pairs of conductors 12, 13 and 16, 17. A fourth conductor pair 22, 23 is provided on the second major surface of the substrate 3 opposite the third conductor pair, as shown in FIG. 9*b* by the cross-section on the line IX B—IX B in FIG. 9*a*. The fourth conductor pair 22, 23 is a quarter wave length long and has a first end connected to the terminals 20, 24 and the second end to the third conductor pair 18, 19. Terminal 20 is connected to terminal 10 and terminal 24 is connected to terminal 14.

The properties of the shunt-T junction are analogous to those described for the series-T junction shown in FIG. 8*a*.

Figure 9C:
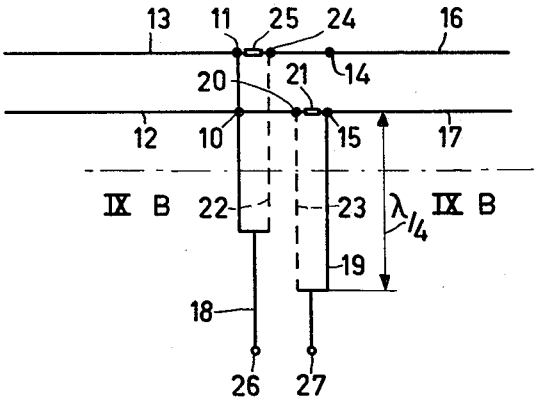
FIG. 9*c* is a schematic plan view of a modification of the shunt-T junction of FIG. 9*a;*

FIG. 9*c* shows a balanced shunt-T junction (a so-called ISO-TEE) obtained by connecting in the shunt-T shown in FIG. 9*a* a first resistor 21 between the fourth terminal 15 and the fifth terminal 20 and by connecting a second resistor 25 between the second terminal 11 and the sixth terminal 24. Resistors 21 and 25 have the same resistance values.

Figure 10:
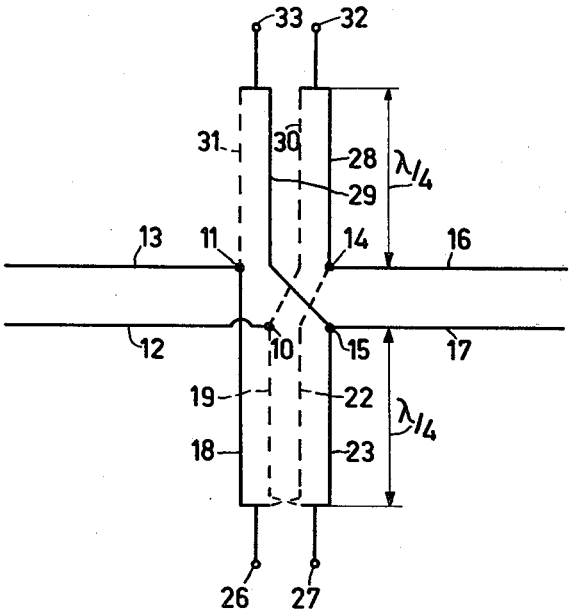
FIG. 10 is a schematic plan view of a "Magic-T" junction for a circuit embodying the invention.

FIG. 10 shows a so-called Magic-T. The Magic-T is composed of the series-T of FIG. 8*a* and the shunt-T of FIG. 9*a*. A first pair of conductors 12, 13 is connected to the terminals 10, 11 and a second pair of conductors 16, 17 to the terminals 14, 15. A third pair of conductors 18, 23 has a first end connected to the terminals 11 and 15 and a fourth pair of conductors 19, 22 has a first end connected to the terminals 10 and 14. The third and fourth pairs of conductors are at right angles to the first and second pairs of conductors. Conductors 19 and 22 are a quarter wavelength long, have their second ends connected to conductors 18 and 23 and to terminals 26 and 27, and are provided on the second major surface of the substrate 3. A fifth pair of conductors 28, 29 has a first end connected to the terminals 14, 15 and a sixth pair of conductors 30, 31 has a first end connected to the terminals 10 and 11. The fifth and sixth pairs of conductors are at right angles to the first and second pairs of conductors. Conductors 30 and 31 are a quarter wavelength long, have a second end connected to conductors 28 and 29 and to terminals 32 and 33, and are provided on the second major surface of the substrate 3. The first, second, third and fourth pairs of conductors form a series-T and the first, second, fifth and sixth pairs of conductors form a shunt-T.

A magic-T has the property that reflection of a wave in a pair of conductors is zero if the other pairs of conductors are terminated by their characteristic impedances. In addition, the magic-T has the property that conductor pair 16, 17 is decoupled from pair 12, 13 and that conductor pair 26, 27 is decoupled from pair 32, 33.

Figure 11:
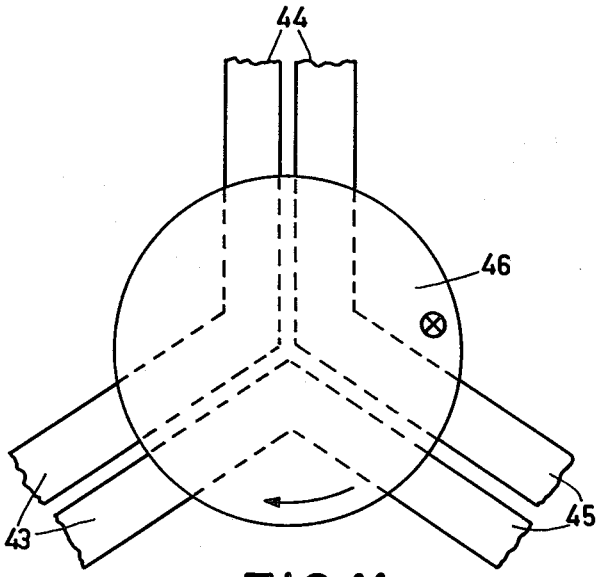
FIG. 11 is a plan view of the strip conductors and a magnet of a circulator.

FIG. 11 shows a circulator in suspended microstrip line. Therein three pairs of conductors 43, 44 and 45, which are arranged at angles of 120° with respect to one another, are interconnected as shown. A ferrite cylinder 46 is provided at the junction of the three pairs of conductors 43, 44 and 45. The direction of the arrow indicates that, for the shown direction of the static magnetic field, a wave which for example enters the junction via the pair of conductors 43 leaves via the pair of conductors 44.

Figure 12A:
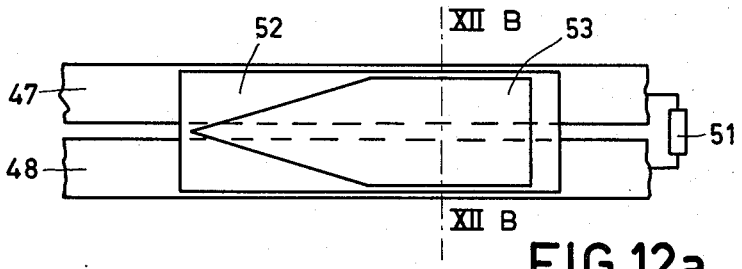
FIG. 12*a* is a plan view of a load impedance for a suspended microstrip circuit embodying the invention.

FIG. 12*a* shows a wide-band, movable load impedance. A member 53 of a resistive material having a resistance per square $R_{\square}$ and part of which is wedge-shaped is provided above the pair of conductors 47, 48. Direct contact between the SOM-line (pair of conductors 47, 48) and the member 53 is prevented by providing a non-conducting plate 52 (i.e. of dielectric material) between the SOM-line and the member 53. Part of the member 53 has the shape of a wedge in order to provide a well-matched loading of the SOM-line, while in addition the SOM-line is terminated with its characteristic impedance 51 ($Z_{oo}$) in order to prevent reflections from occurring behind the member 53 (that is to say behind the end which is not wedge-shaped).

Figure 12B:
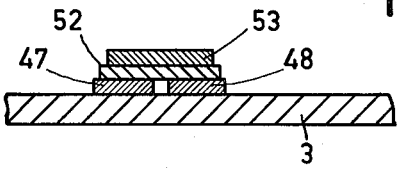
FIG. 12*b* is a cross-sectional view on the line XII B—XII B in FIG. 12*a;*

FIG. 12*b* is a cross-section along the line XII B—XII B in FIG. 12*a*.

Figure 13A:
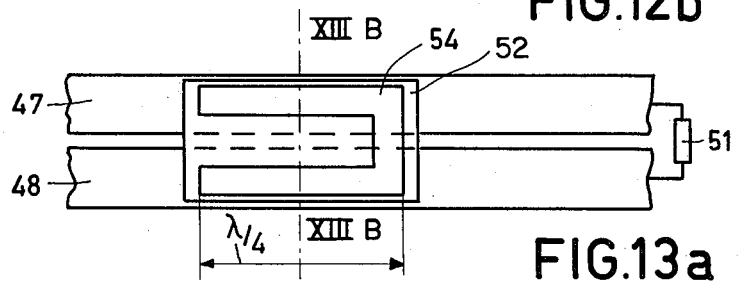
FIG. 13*a* is a plan view of a short-circuit for a suspended microstrip circuit embodying the invention.

FIG. 13*a* shows a narrow-band, movable short-circuit for a suspended microstrip line. A U-shaped conductor 54 is provided over the pair of conductors 47, 48, being insulated therefrom by a non-conducting plate 52. The SOM-line is terminated with its characteristic impedance 51 ($Z_{oo}$) in order to prevent or attenuate reflections behind the U-shaped conductor 52. The legs of the U are a quarter wavelength long to effect RF coupling between the SOM-line and the U-shaped conductor 54 over a small band.

Figure 13B:
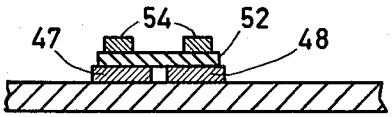
FIG. 13*b* is a cross-sectional view on the line XIII B—XIII B in FIG. 13*a;*

FIG. 13*b* is a cross-section on the line XIII B—XIII B in FIG. 13*a*.

Figure 14A:
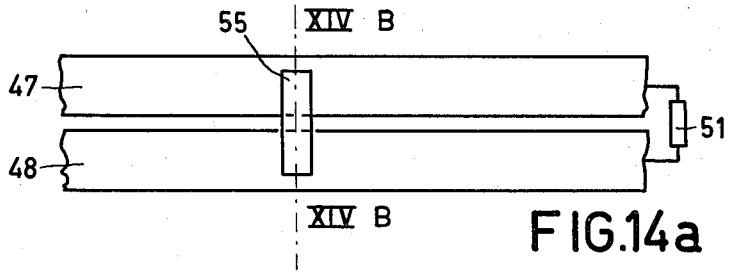
FIG. 14 is a plan view of a short-circuit for a suspended microstrip circuit embodying the invention.
FIG. 14*b* is a cross-sectional view on the line XIV B—XIV B in FIG. 14*a.*

FIG. 14*a* shows a wide-band, movable short-circuit for a suspended microstrip line. A conductive strip 55 is provided on the pair of conductors 47, 48. The SOM-line is terminated with its characteristic impedance 51 ($Z_{oo}$).

Figure 14B:
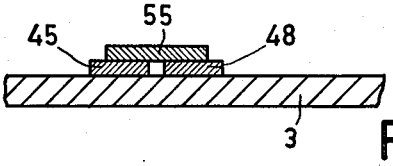

FIG. 14*b* is a cross-section on the line XIV B—XIV B in FIG. 14*a*.

The invention is in no way limited to the microwave circuits shown. Filters, attenuators and phase shifters can, for example, also be implemented in suspended microstrip line. Microwave circuits can also comprise active elements as, for example, Schottky-barrier diodes or transistors, by means of which mixers and amplifiers can, for example, be realized.

What is claimed is:

1. A suspended microstrip circuit having two parallel electrically conducting planes, a dielectric substrate arranged in parallel therebetween and a first strip conductor provided on a first surface of the substrate, characterized in that:

a second strip conductor is provided on the first surface of the substrate in parallel with and at a short distance from said first strip conductor and being coupled to said first strip conductor;

a balanced supply source is connected between said two strip conductors for generating a wave phenomenon in the odd mode exclusively;

a symmetrical load is connected between said two strip conductors for terminating said suspended microstrip circuit.

2. A suspended microstrip circuit as claimed in claim 1 characterized in that said balanced supply source comprises:

an asymmetrical supply source;

a slotted transmission line provided on a second surface of the substrate and formed by a slot between two electrically conducting planes provided on the substrate;

said slot coupled to said asymmetrical supply source;

a connecting conductor provided on said first surface between an end of said first conductor and a corresponding end of said second conductor;

said connecting conductor being arranged symmetrically with respect to and coupled to said slotted transmission line for converting the odd modes in the slotted transmission line into an exclusively odd-mode wave phenomenon.

3. A suspended microstrip circuit as claimed in claim 1, characterized in that there are arranged on said first surface of the dielectric substrate:

four terminals whose angles form an imaginary rectangle;

a first microstrip line connected to a first and to a second of said four terminals belonging to the same side of said rectangle;

a second microstrip line connected to a third and a fourth of said four terminals of said rectangle, the conductors of said first and said second microstrip line being in-line;

a third microstrip line connected to said second and to said third of said four terminals which belong to the same side of said rectangle, said third microstrip line being at a right angle to said first and to said second microstrip lines;

a fifth terminal;

a sixth terminal;

a connection between said first terminal and said fifth terminal;

on a second surface of said dielectric substrate a fourth microstrip line situated opposite said third microstrip line, which fourth microstrip line is a quarter wavelength long, having a first end connected to said fifth terminal and to said sixth terminal and a second end of said fourth microstrip line connected to said third microstrip line; and a connection between said fourth and said sixth terminal provided for effecting a series-T junction.

4. A suspended microstrip circuit as claimed in claim 3, characterized in that the third terminal is connected to the fifth terminal through a first resistor and the second terminal to the sixth terminal through a second resistor and that the resistance value of the first resistor is equal to that of the second resistor.

5. A suspended microstrip circuit as claimed in claim 1, characterized in that there are arranged on said first surface of the substrate:

four terminals forming angles of an imaginary quadrilateral;

a first microstrip line connected to a first and a second of said four terminals belonging to the same side of said quadrilateral;

a second microstrip line connected to a third and a fourth of said four terminals, the conductors of said first and said second microstrip lines being in-line;

a third microstrip line connected to said first and to said third of said four terminals which do not belong to the same side of said quadrilateral, said third microstrip line being at a right angle to said first and said second microstrip lines;

a fifth terminal;

a sixth terminal;

a connection between said second and said fifth terminals and a connection between said fourth and said sixth terminals; and, a fourth microstrip line provided on a second surface of said substrate which is situated opposite said third microstrip line and which is a quarter wavelength long and having a first end connected to said fifth terminal and to said sixth terminal for effecting a shunt-T junction.

6. A suspended microstrip circuit as claimed in claim 5, characterized in that the first terminal is connected to the sixth terminal through a first resistor and the third terminal to the fifth terminal through a second resistor and that the resistance value of the first resistor is equal to that of the second resistor.

7. A suspended microstrip circuit as claimed in claim 1, characterized in that said two electrically conducting planes are composed of conductive and resistive portions for the attenuation of even modes.

8. A suspended microstrip circuit as claimed in claim 1, characterized in that in a bend of the microstrip line said first and said second strip conductors are interrupted by a slot into the direction of the bisector of the deflection angle and said first conductors are cross-wise connected to said second conductors.

9. A suspended microstrip circuit as claimed in claim 1, characterized in that there are arranged on said first surface of said dielectric substrate:

four terminals which form the angles of an imaginary quadrilateral;

a first microstrip line connected to a first and to a second of said four terminals belonging to the same side of said quadrilateral;

a second microstrip line connected to a third and a fourth of said four terminals, the conductors of said first and said second microstrip lines being in-line;

a third microstrip line connected to said first and to said fourth of said four terminals which do not belong to the same side of said quadrilateral; said third microstrip line being at a right angle to said first and said second microstrip lines;

a fifth terminal;

a sixth terminal;

a fourth microstrip line connected to said third terminal and to said fifth terminal, said fourth microstrip line being in-line with said third microstrip line;

a connection between said fifth terminal and said fourth terminal, there being provided on a second surface of said dielectric substrate a fifth microstrip line which is situated opposite said third microstrip line and which is a quarter wavelength long and has a first end connected to said second terminal and to said third terminal and a second end of the fifth microstrip line is connected cross-wise to said third microstrip line and arranged on said second surface of the dielectric substrate there is a sixth microstrip line which is situated opposite said fourth microstrip line and which is a quarter wavelength long and has one end connected to said first terminal and to said sixth terminal, said sixth terminal being connected to said second terminal and a second end of said sixth microstrip line being connected to said fourth microstrip line for effecting a magic-T junction.

* * * * *